US006931891B2

(12) United States Patent
Killane

(10) Patent No.: US 6,931,891 B2
(45) Date of Patent: Aug. 23, 2005

(54) WASHING MACHINE WITH A DRAIN PUMP

(75) Inventor: Simon John Killane, Malmesbury (GB)

(73) Assignee: Dyson Limited, Wiltshire (GB)

( * ) Notice: Subject to any disclaimer, the term of this patent is extended or adjusted under 35 U.S.C. 154(b) by 278 days.

(21) Appl. No.: 10/366,662

(22) Filed: Feb. 14, 2003

(65) Prior Publication Data

US 2003/0121293 A1 Jul. 3, 2003

Related U.S. Application Data

(62) Division of application No. 09/959,771, filed as application No. PCT/GB00/01673 on May 2, 2000, now Pat. No. 6,584,812.

(30) Foreign Application Priority Data

May 7, 1999 (GB) ..... 9910623

(51) Int. Cl.[7] ..... D06F 39/10

(52) U.S. Cl. ..... 68/3 R; 68/18 F; 134/104.1; 134/104.2

(58) Field of Search ..... 68/3 R, 18 F, 207; 134/57 D, 58 D, 104.1, 104.2, 104.4, 111

(56) References Cited

U.S. PATENT DOCUMENTS

| | | | | |
|---|---|---|---|---|
| 1,672,286 A | * | 6/1928 | Stingham et al. | 134/25.2 |
| 2,023,013 A | * | 12/1935 | Faber et al. | 8/159 |
| 2,201,790 A | * | 5/1940 | Rouch | 68/208 |
| 2,343,743 A | * | 3/1944 | Breckenridge | 68/208 |

(Continued)

FOREIGN PATENT DOCUMENTS

| | | | |
|---|---|---|---|
| CH | 542 309 | | 11/1973 |
| DE | 1 585 818 | | 10/1971 |
| DE | 28 27 254 | * | 1/1990 |
| DE | 39 36 617 | | 5/1991 |
| EP | 0 334 836 | | 9/1989 |
| GB | 2 276 888 | | 9/1993 |
| GB | 2 190 926 | * | 12/1997 |
| JP | 60-173392 | | 9/1985 |
| JP | 7-284468 | * | 10/1995 |
| JP | 9-66017 | * | 3/1997 |
| JP | 2000-14620 | * | 1/2000 |
| TW | 398443 | | 7/1997 |

OTHER PUBLICATIONS

European Patent Office 597,508 Aug. 1993.*

*Primary Examiner*—Frankie L. Stinson
(74) *Attorney, Agent, or Firm*—Morrison & Foerster LLP

(57) ABSTRACT

The invention provides a washing machine (10) having a front panel (11), a tube (14) for containing articles to be washed, a water inlet (16) for admitting water to the tub, a water outlet (26) for discharging water from the tub (14), a pump (50) for pumping water from the tub (14) to the water outlet (26) and a cointrap (60) located in the water outlet (26) between the tub (14) and the pump (50), characterised in that the cointrap (60) is positioned within the front panel (11) to allow the contents of the cointrap (60) to be viewed. The invention also provides a washing machine (10) having a tub (14) for containing articles to be washed, a water inlet (16) for admitting water to the tub, a water outlet (26) for discharging water from the tub (14), a pump (50) for pumping water from the tub (14) to the water outlet (26) and a cointrap (60) located in the water outlet (26) between the tub (14) and the pump (50), the cointrap (60) having a housing (62), the housing (62) having a panel (76) moveable between a first position and a second position, characterised in that the moveable panel (76) has a drainage outlet (80), in that, in the first position, the moveable panel (76) is sealed to the housing (62) and the drainage outlet (80) is closed, and in that, in the second position, the moveable panel (76) is sealed to the housing (62) and the drainage outlet (80) is open.

13 Claims, 4 Drawing Sheets

U.S. PATENT DOCUMENTS 2,360,278 A * 10/1944 Robertson ..... 68/18 F
2,413,954 A * 1/1947 Conterman ..... 210/451
2,562,076 A * 7/1951 Weisselberg ..... 134/139
2,575,542 A * 11/1951 Wubbe ..... 210/454
2,586,508 A * 2/1952 Brotman ..... 210/437
2,592,597 A * 4/1952 Pengelly ..... 68/23.5
2,651,190 A * 9/1953 Horvath ..... 68/12.14
2,938,366 A * 5/1960 Maddock-Clegg ..... 68/17 R
2,969,665 A * 1/1961 Saverio ..... 68/184
3,088,305 A 5/1963 Ohmann
3,385,085 A * 5/1968 Engel ..... 68/18 F
4,485,645 A 12/1984 Mulder et al.
4,556,970 A * 12/1985 Flanagin et al. ..... 370/422
4,580,421 A * 4/1986 Babuin et al. ..... 68/12.13
5,660,063 A * 8/1997 Lee et al. ..... 68/18 F
6,458,281 B2 * 10/2002 Magnoff ..... 210/767

* cited by examiner

WASHING MACHINE WITH A DRAIN PUMP

REFERENCE TO RELATED APPLICATIONS

This application is a division of Ser. No. 09/959,771, filed Nov. 7, 2001, which is now U.S. Pat. No. 6,584,812, which is a national stage application under 35 USC 371 of International Application No. PCT/GB00/01673, filed May 2, 2000. These prior applications are hereby incorporated by reference.

The invention relates to a domestic appliance. Specifically, the invention relates to a washing machine.

A conventional washing machine consists of a tub or drum in which articles to be washed are placed and means are provided for agitating the articles inside the tub or drum in the presence of water and detergent. Inlet means for providing water and detergent to the tub or drum form part of the washing machine. The tub or drum is also provided with a water outlet via which water or water and detergent can be drained from the tub or drum. A pump is provided in the water outlet for removing water from the tub or drum.

It sometimes happens that small objects are inadvertently placed in the tub or drum when the articles to be washed are placed therein. It is also possible for items such as buttons or other fastening or decorative items to become dislodged from the articles during the washing process. It is highly undesirable for these items to pass through the pump since this could cause damage to the pump itself. In order to reduce the risk of any foreign body passing through the pump, a cointrap is placed upstream of the pump in the water outlet. The cointrap is essentially a chamber having a cross sectional area which is significantly larger than that of the water outlet, which is normally formed by means of a pipe or conduit. The increased area of the chamber causes a reduction in the velocity of the out-going water and large items which were previously carried along with the flow of out-going water drop out of the flow and collect in the cointrap. It will be understood that all reasonably sized items will be caught by the cointrap, which is not specifically designed to trap only coins. Buttons, paper clips, zipper heads and other items which might otherwise damage the impellers of the pump will also reliably be extracted from the outflow of the water and retained within the cointrap.

It is a disadvantage of known washing machines that, in order to inspect the interior of the cointrap, perhaps to recover a specific item, a portion of the cointrap must be removed in order to gain access. This is particularly inconvenient if it is not known whether the item being sought is located within the cointrap. Furthermore, cointraps can collect significant numbers of items over a period of time and, if the number of items collected is too great, the contents of the cointrap can begin to restrict the outflow of water from the tub or drum. Apart from an inevitable decrease in the efficiency of the cointrap, this can also result in an increased risk that a foreign item or body may enter the pump and may cause damage thereto.

It is a further disadvantage of known washing machines that when a cointrap requires to be opened for access, perhaps to retrieve an item retained therein or to remove a blockage from the adjacent pump, the cointrap is usually filled with water. This can make the process of gaining access to the cointrap inconvenient and messy. In turn, this discourages the user from accessing the cointrap at regular intervals in order to empty it.

It is an object of the present invention to provide a washing machine having a cointrap in which access to the cointrap is gained only when access is known to be required.

It is a further object of the invention to provide a washing machine having a cointrap which can be easily and conveniently accessed. A further object of the invention is to provide a washing machine having a cointrap which is simple and convenient to maintain.

A first aspect of the invention provides a washing machine having a front panel, a tub for containing articles to be washed, a water inlet for admitting water to the tub, a water outlet for discharging water from the tub, a pump for pumping water from the tub to the water outlet and a cointrap having a transparent window, the cointrap located in the water outlet between the tub and pump, characterised in that the cointrap is positioned within the front panel to allow the contents of the cointrap to be viewed.

The provision of a transparent window in the cointrap allows a user visual access to the contents of the cointrap. This enables the user to see whether a specifically sought item has been trapped in the cointrap. It also allows the user to become aware when the cointrap is becoming full. The user is then alerted to the fact that maintenance is required. If the window provides visual access to the pump as well as to the interior of the cointrap, then the user can inspect the operation of the pump in the event that a malfunction is suspected.

A second aspect of the invention provides a washing machine having a tub for containing articles to be washed, a water inlet for admitting water to the tub, a water outlet for discharging water from the tub, a pump for pumping water from the tub to the water outlet and a cointrap located in the water outlet between the tub and the pump, the cointrap having a housing, the housing having a panel moveable between a first position and a second position, characterised in that the moveable panel has a drainage outlet, in that, in the first position, the moveable panel is sealed to the housing and the drainage outlet is closed, and in that, in the second position, the moveable panel is sealed to the housing and the drainage outlet is open.

Preferably, the moveable panel remains sealed to the housing during movement between the first position and the second position. More preferably, a moulded rubber seal is located between the housing and the moveable panel.

The provision of a drainage outlet which can be opened merely by movement of a moveable panel of the cointrap allows any water retained in the cointrap to be drained before physical access to the cointrap is gained. Preferably, the moveable portion is circular and is moveable about an axis of the cointrap which, preferably, is located centrally of the moveable panel.

It is preferred if, in the case of front-loading washing machines, the window or moveable portion of the cointrap is located so that it forms part of the front panel of the washing machine. This will provide convenient and immediate access to the window or moveable panel for the user. Further and advantageous features of the invention are set out in the subsidiary claims.

An embodiment of the invention will now be described, by way of example only, with reference to the accompanying drawings, in which.

Figure 3:
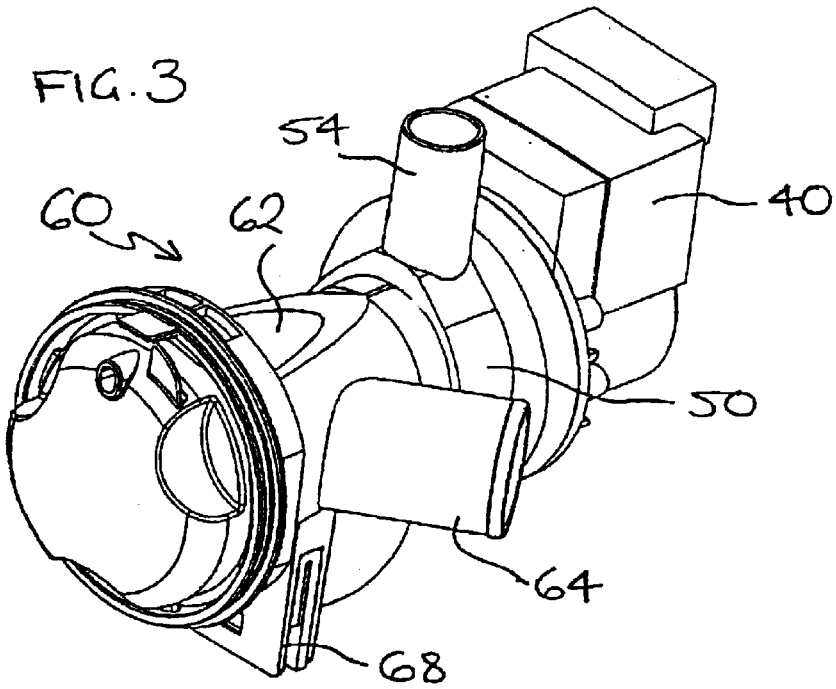
FIG. 3 is a perspective view of a cointrap forming part of the washing machine of FIGS. 1 and 2.
Figure 4:
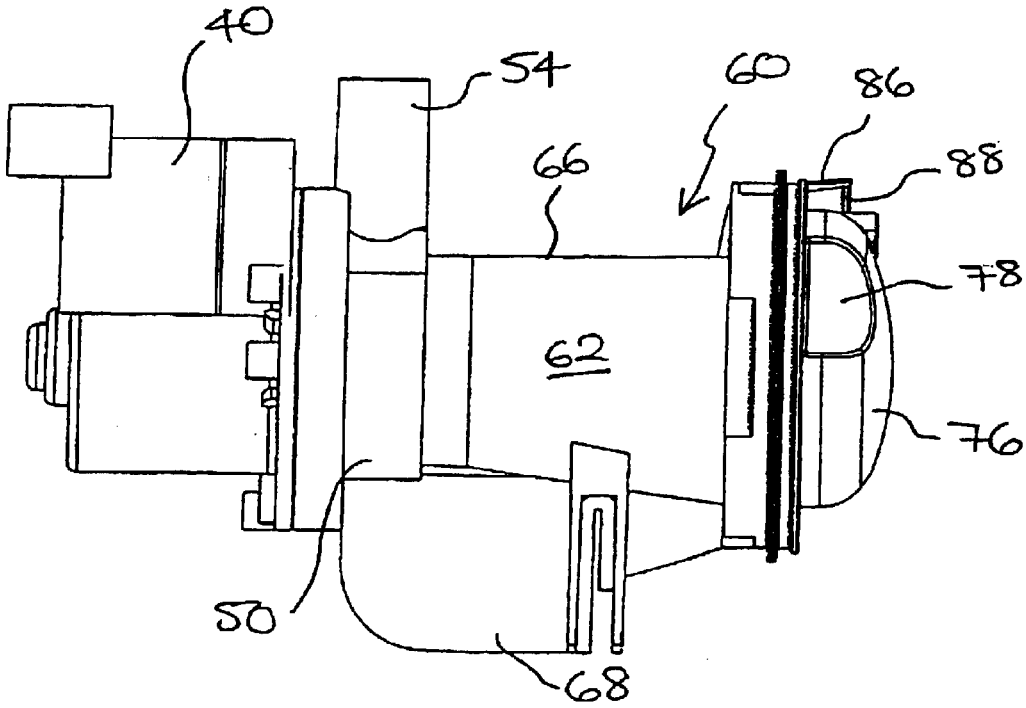
FIG. 4 is a side view of the cointrap of FIG. 3.
Figure 8A:
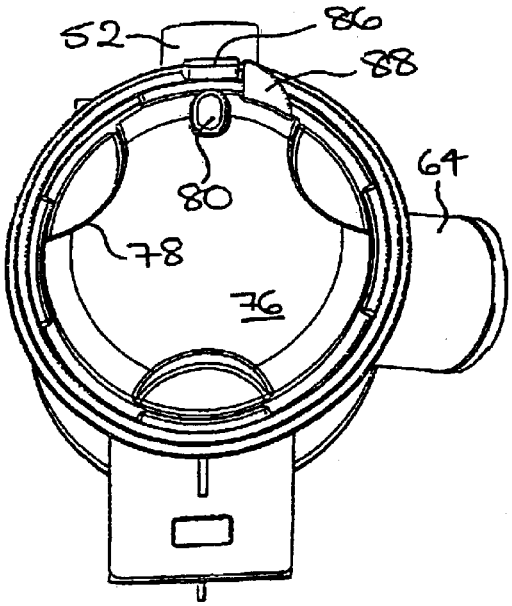
Figure 8B:
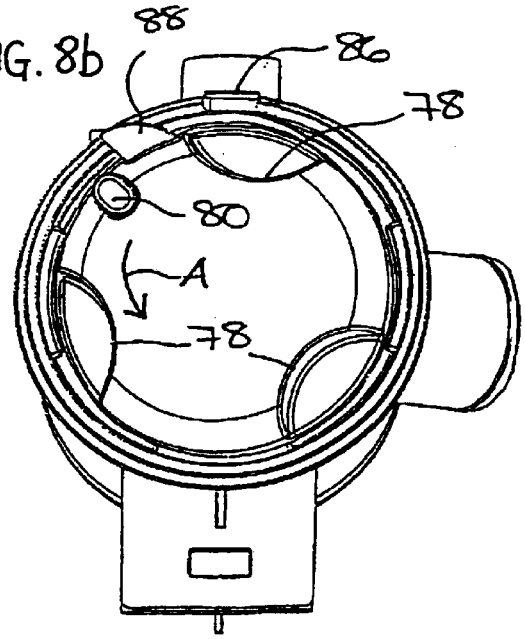

FIG. 8*a* is a front view of the cointrap of FIG. 3 showing the front panel in a first position; and FIG. 8*b* is a front view of the cointrap of FIG. 3 showing the front panel in a second position.

Figure 1:
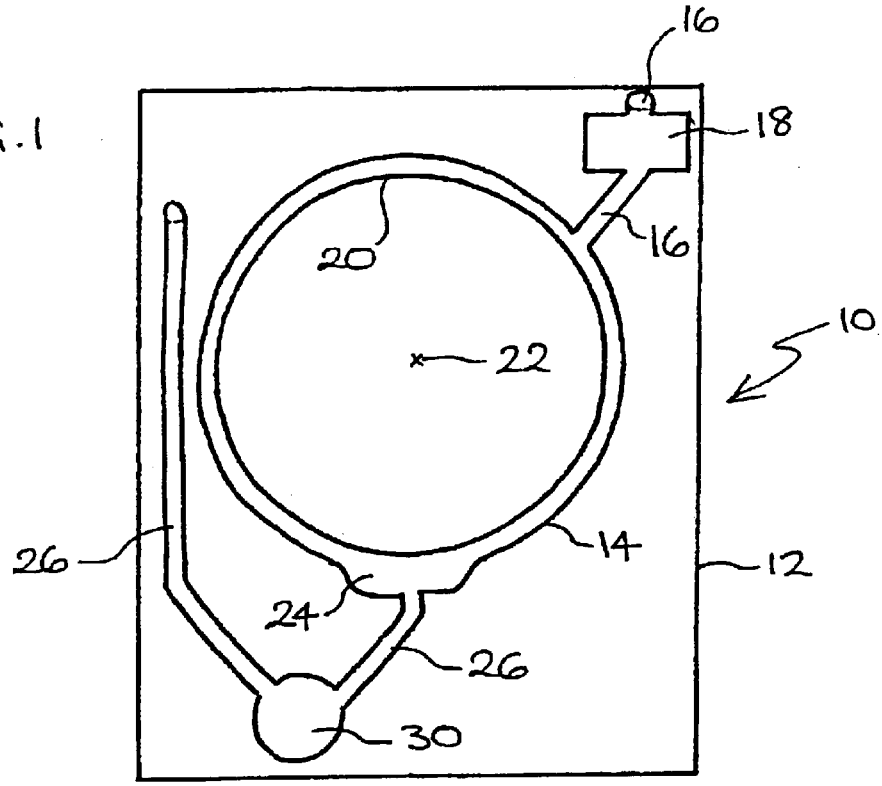
FIG. 1 is a schematic front view of a washing machine according to the invention in which the front panel thereof has been omitted.
Figure 2:
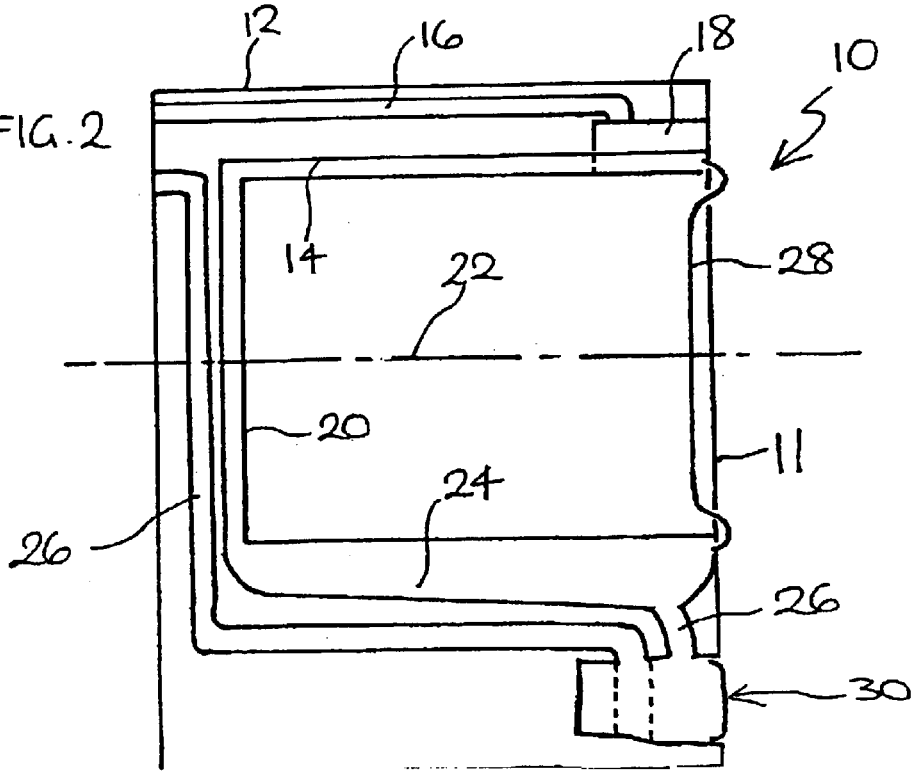
FIG. 2 is a schematic side view of the washing machine illustrated in FIG. 1, in which the nearest side panel has been removed.

Referring initially to FIGS. 1 and 2, there is illustrated therein a washing machine 10 according to the invention. The washing machine 10 generally comprises a rectangular frame 12 in which is located a stationery tub 14. A water inlet conduit 16 is provided with means for connection to an appropriate water supply (not shown) in a known manner.

The water inlet conduit 16 has a soap tray 18 located therein and also communicates with the interior of the tub 14. Rotatably mounted within the tub 14 is a perforated drum 20 which is mounted about a central axis 22 and connected to an appropriate motor or other drive means (not shown) so that the drum 20 can be rotated about the central axis 22 in a known manner. The tub 14 in which the drum 20 is located incorporates a sump 24 having an outlet conduit 26 which communicates with appropriate drainage means (not shown). A door 28 is provided on the front of the washing machine 10 to allow access to the interior of the drum 20. Appropriate fastening and sealing means are provided in a known manner and will not be described any further here.

A combined pump and cointrap 30 is provided in the outlet conduit 26 so that, at appropriate intervals during the operation of the washing machine 10, water can be pumped from the interior of the tub 14 to the drainage means via the outlet conduit 26. FIGS. 1 and 2 illustrate the position of the combined pump and cointrap 30. As can be seen from the illustrations, the combined pump and cointrap 30 is positioned below the tub 14 and at the front of the washing machine 10 so that a front panel of the cointrap can be located in and, thereby form part of, a front panel 11 of the washing machine 10. The reasons for and advantages of this arrangement will become clear from the description given below.

Figure 5:
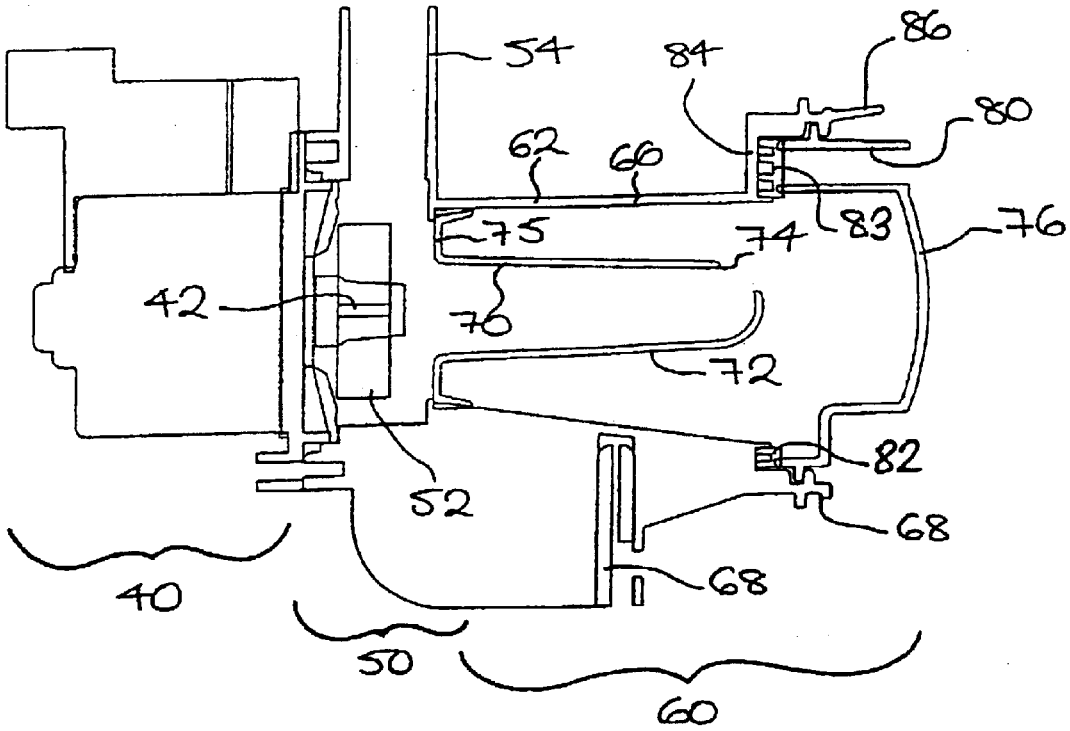
FIG. 5 is a sectional side view, similar to FIG. 4, of the cointrap of FIG. 3.

The combined pump and cointrap 30 will now be described in more detail with reference to FIGS. 3 to 6. Essentially, the combined pump and cointrap 30 comprises three separate portions: a motor 40, a pump 50 and a cointrap 60. The motor 40 is a standard motor of any appropriate configuration which can be used to drive the vanes 52 of the pump 50. The vanes 52 of the pump 50 are mounted on an output shaft 42 of the motor 40 so as to rotate therewith. The motor 40 is sealed from the pump 50 in a known manner. The pump 50 includes an outlet 54 which communicates with the outlet conduit 26 in any suitable manner. The outlet 54 extends radially outwardly from the vanes 52. In the specific embodiment shown, the outlet 54 is orientated in a vertically upward direction with the vanes 52 of the pump 50 located directly beneath the outlet 54 as shown in FIG. 5, although other configurations are possible and equally acceptable.

The cointrap 60 comprises a housing 62 communicating with an inlet 64 whose cross sectional area is significantly less than that of the housing 62. The housing 62 is formed by a generally cylindrical housing wall 66 with which mountings 68 are integrally moulded. The mountings 68 allow the combined pump and cointrap 30 to be mounted in the appropriate position within the washing machine 10. The shape and configuration of the mountings 68 are immaterial to the present invention and can take any appropriate shape or form. They will therefore not be described in any further detail here.

An internal conduit 70 is located inside the housing 62. The internal conduit 70 comprises a generally cylindrical portion 72 which is closed at one end thereof. A plurality of apertures 74 are formed in the closed end of the cylindrical portion 72, which is the end furthest from the fan 50, so as to allow water to pass from the interior of the housing 62 into the interior of the cylindrical portion 72 of the internal conduit 70. The opposite end of the cylindrical portion 72 is open to the interior of the pump 50, and indeed, forms the inlet thereto. An annular flange 75 extends between the end of the cylindrical portion 76 adjacent the pump 50 towards the housing wall 66 so as to locate the internal conduit 70 within the housing 62. The internal conduit 70 may be moulded from a clear plastics material and is dimensioned so as to locate within the housing 62 by means of an interference fit, although other means of locating the internal conduit 70, such as snapfitting and screw-threaded fittings, are just as suitable and equally appropriate. The arrangement of the internal conduit 70 as described above does not form part of the present invention and other configurations are possible and equally acceptable.

The end of the cointrap 60 remote from the pump 50 is closed by a moveable panel 76. The moveable panel 76 is generally circular in shape and has a slightly convex outer surface. The moveable panel 76 has a plurality of finger-gripping portions 78 moulded into the front surface thereof. In the embodiment shown, three finger-gripping portions 78 are provided. However, a different number of finger-gripping portions 78 can be provided if desired. The moveable panel 76 is attached to the housing 62 by means of screw-threaded portions or bayonet fittings (not shown) which allow the moveable panel 76 to be rotated about the longitudinal axis of the cointrap 60. A moulded seal 82 seals the moveable panel 76 to the housing. The seal 82 is moulded from a rubber material but could equally be moulded from any other suitable material. The moveable panel 76 is manufactured from a transparent plastics material.

An aperture 80 is provided in the moveable panel 76 and extends therethrough. Under normal operating conditions, the moveable panel 76 will be positioned so that the aperture 80 is located uppermost. Located immediately rearwardly of the aperture 80 is the seal 82 which is mounted on and supported by an upwardly extending support wall 84 which is integrally moulded with the housing wall 66 of the cointrap 60. The seal 82 has an enlarged flanged portion 83 adjacent the support wall 84. When the moveable panel 76 is arranged so that the aperture 80 is in the uppermost position, the enlarged flanged portion 83 of the seal 82 prevents any passage of water from the interior of the housing 62 through the aperture 80 to the exterior of the cointrap 60.

A safety mechanism is built into the cointrap 60 in the manner of a protruding tab 86 located on the distal end of the support wall 84 and an upwardly extending catch 88 mounted on the moveable panel 76. The protruding tab 86 and/or the support wall 84 is or are configured so as to incorporate a certain amount of resilience. By the application of sufficient upward force on the distal end of the protruding tab 86, the protruding tab 86 can be lifted in order to allow the catch 88 to pass thereunder. However, without the application of sufficient upward force on the protruding tab 86, the catch 88 is prevented from moving past the protruding tab 86. This ensures that the moveable panel 76 may not be inadvertently rotated in an anticlockwise direction about the axis of the cointrap 60. The screw-threaded portions by means of which the moveable panel 76 is attached to the housing 62 terminate in a position which prevents the front panel 76 from rotating in a clockwise direction from the position shown in FIG. 6.

The combined pump and cointrap 30 operate in the following manner. When it is desired to drain water from the tub 14, the motor 40 is operated so as to rotate the vanes 52 of the pump 50. Water is thus drawn from the tub 14 along the outlet conduit 26 and into the housing 62 of the cointrap 60 via the inlet 64. Because the cross sectional area of the interior of the housing 62 is large in comparison to the cross sectional area of the outlet 26, the velocity of the water entering the cointrap 60 decreases. Any large or heavy bodies previously entrained within the flow of water will collect within the housing 62. Water exits the interior of the housing 62 via the apertures 74 in the interior conduit 70. The dimensioning of the apertures 74 provides a further safeguard against large objects entering the pump 50. Water passes along the cylindrical portion 72 of the internal conduit 70 and is pumped by the vanes 52 of the pump 50 out of the combined pump and cointrap 30 via the outlet 54. The water then passes along the remainder of the outlet conduit 26 to the drainage means.

Figure 6:
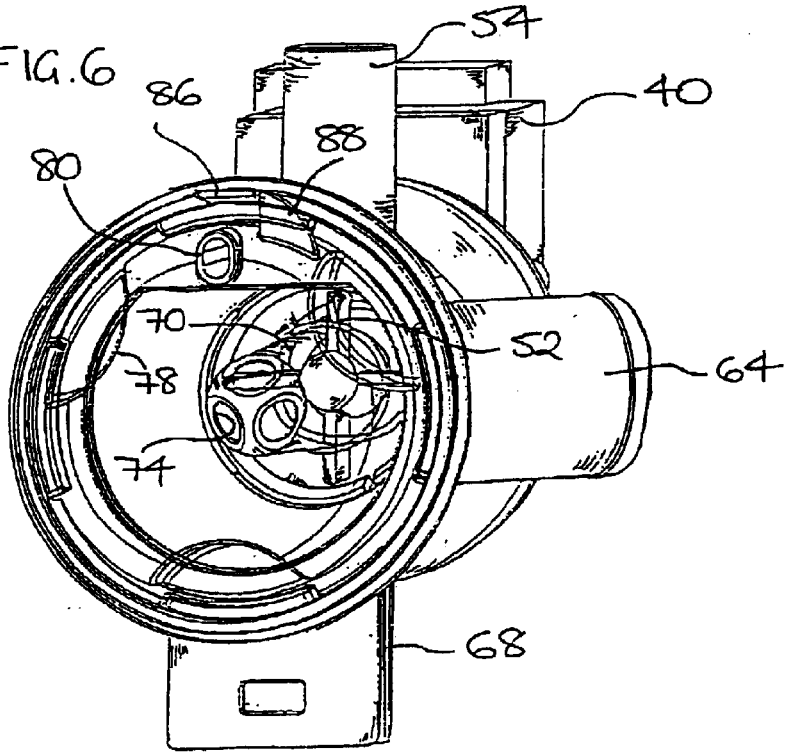
FIG. 6 is a second perspective view of the cointrap of FIG. 3.

The fact that the moveable panel 76 is made from a transparent plastics material means that the user of the washing machine 10 can instantly and easily view, from in front of the machine 10, the interior of the cointrap 60 in order to determine whether any foreign objects have been collected. This is particularly useful if the user of the washing machine 10 suspects that a specific object has passed through the washing machine 10. By virtue of the transparency of the moveable panel 76, the user is not required to repeatedly drain and access, in a physical manner, the interior of the cointrap 60 in order to determine whether or not the object of the search has been trapped. A further advantage of the transparency of the moveable panel, in combination with the feature of the internal conduit 70 which may also be manufactured from a transparent material, is that the user can view the vanes 52 of the pump 50. This has the advantage that, if the washing machine 10 malfunctions and it is suspected that the motor 40 is inoperative, the user can immediately detect whether or not this is the case by viewing the rotation or otherwise of the vanes 52 of the pump 50. FIG. 6 illustrates the manner in which visual access to the interior of the cointrap and the vanes 52 of the pump 50 can be gained.

Figure 7:
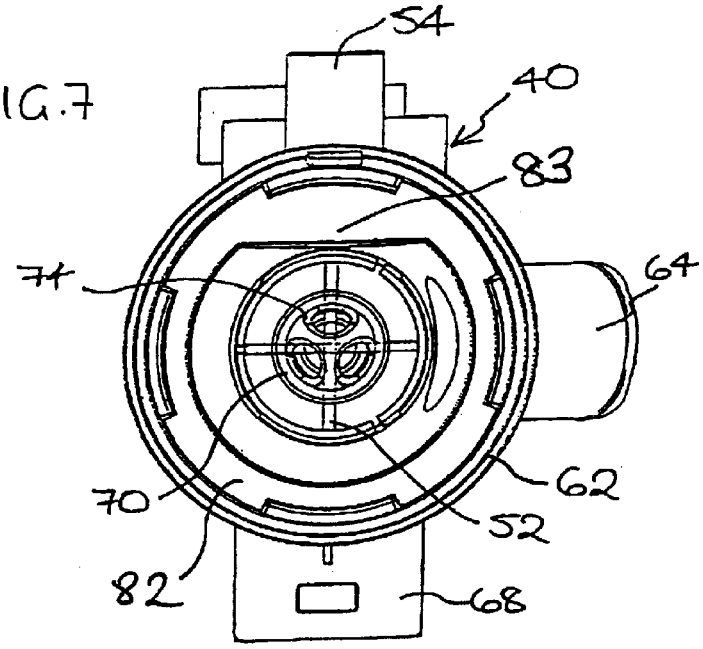
FIG. 7 is a front view of the cointrap of FIG. 3 with the front panel removed.

FIG. 7 is a front view of the combined pump and cointrap 30 with the moveable panel 76 removed. In this Figure, the support wall 84 can be seen. A similar view is shown in FIG. 8*a* with the moveable panel 76 in place and in an operative position, ie. when no physical access to the interior of the cointrap 60 is required. As can be seen, the catch 88 protrudes sufficiently far from the periphery of the moveable panel 76 to engage with the protruding tab and prevent rotation of the moveable panel 76 in the direction of arrow A. If it is desired to gain physical access to the cointrap 60, the protruding tab 86 must be lifted, preferably using a suitable tool, so that the catch 88 can pass thereunder. The moveable panel 76 is then rotated about its axis so that the aperture 80 is no longer closed by the seal 82. This allows any water contained within the housing 62 of the cointrap 60, and indeed within the pump 50 and the outlet conduit 26, to drain through the aperture 80. The moveable panel 76 remains sealed to the housing 62 by the seal 82 during the rotation. It is preferred that the aperture 80 is located within the washing machine 10 sufficiently far above the surface on which the washing machine 10 stands to allow for a suitable receptacle to be positioned under the aperture 80 to collect draining water. Once the majority of the water which requires to be drained has passed through the aperture 80, the moveable panel 76 can be rotated further in the direction of arrow A to complete the draining procedure. The moveable panel 76 can then be fully unscrewed from the housing 62 in order to allow physical access to the cointrap 60 to be gained.

The invention is not intended to be limited to the precise embodiment illustrated in the accompanying drawings. Although a combined pump and cointrap 30 has been disclosed, it will be appreciated that the cointrap 60 can be provided separately from the pump and motor 50, 40. In this event, it is likely to be impossible to provide visual access to the vanes 52 of the pump 50, but such a variation is intended to fall within the scope of the invention. Other variations and modifications will be apparent to a skilled reader.

What is claimed is:

1. A washing machine having a tub for containing articles to be washed, a water inlet for admitting water to the tub, a water outlet for discharging water from the tub, a pump for pumping water from the tub to the water outlet and a cointrap located in the water outlet between the tub and the pump and having a housing comprising a panel moveable between a first position and a second position, wherein the moveable panel has a drainage outlet, in that, in the first position, the moveable panel is sealed to the housing and the drainage outlet is closed, and in that, in the second position, the moveable panel is sealed to the housing and the drainage outlet is open.

2. A washing machine as claimed in claim 1, wherein the moveable panel remains sealed to the housing during movement between the first position and the second position.

3. A washing machine as claimed in claim 2, wherein a moulded rubber seal is located between the housing and the moveable panel.

4. A washing machine as claimed in claim 1, wherein the drainage outlet comprises an aperture in the moveable panel.

5. A washing machine as claimed in claim 4, wherein a moulded rubber seal is located between the housing and the moveable panel, the drainage outlet comprises an aperture in the moveable panel and, in the first position, the aperture is closed by the moulded rubber seal.

6. A washing machine as claimed in claim 5, wherein the moulded rubber seal has an enlarged flanged portion located such that, in the first position, the aperture is closed by the enlarged flanged portion.

7. A washing machine as claimed in claim 1, wherein the moveable panel is moveable between the first and second positions by rotation about an axis of the cointrap.

8. A washing machine as claimed in claim 7, wherein the axis of the cointrap is located centrally of the moveable panel.

9. A washing machine as claimed in any one of claims 1 to 8, wherein the moveable panel is circular in shape.

10. A washing machine as claimed in any one of claims 1 to 8, wherein the moveable panel forms a front panel of the cointrap.

11. A washing machine as claimed in any one of claims 1 to 8, wherein the washing machine has a front panel and the moveable panel of the cointrap forms part of the front panel of the washing machine.

12. A washing machine as claimed in claim 11, wherein the front panel of the washing machine is generally planar and the moveable panel is coplanar with the front panel.

13. A washing machine as claimed in any one of claims 1 to 8, wherein the moveable panel is transparent.

* * * * *